US005969244A

United States Patent [19]

Machado

[11] Patent Number: 5,969,244

[45] Date of Patent: Oct. 19, 1999

[54] SWITCH ASSEMBLY FOR WITHSTANDING SHOCK AND VIBRATION

[75] Inventor: Peter W. Machado, Fairhaven, Mass.

[73] Assignee: The United States of America as represented by the Secretary of the Navy, Washington, D.C.

[21] Appl. No.: 09/064,360

[22] Filed: Apr. 13, 1998

[51] Int. Cl.[6] ..... H01H 1/66

[52] U.S. Cl. ..... 73/431; 335/156

[58] Field of Search ..... 73/431; 335/202, 335/155, 156; 29/622, 855, 856

[56] References Cited

U.S. PATENT DOCUMENTS 3,005,069 10/1961 Sippach et al. .
5,438,869 8/1995 Mueller et al. .

*Primary Examiner*—Robert Raevis

*Attorney, Agent, or Firm*—Michael J. McGowan; Robert W. Gauthier; Prithvi C. Lall

[57] ABSTRACT

A switch assembly and method of making same are provided. First and second seals are mounted in spaced apart relation about the elongate body of a delicate switch such as a reed switch. The resulting switch/seal assembly is inserted into a rigid housing that encases the switch and seals. The housing is in circumferential contact with each seal. The seals are spaced apart from one another to reside on either side of a port in the side of the housing so that an annular chamber is defined between the elongate body and the housing between the seals. A damping material is injected through the port to fill the annular chamber. The housing can extend past the elongate body at either end to define first and second open-ended chambers through which electrical leads extending from the elongate body pass through. The damping material can also be used to fill the first and second open-ended chambers once electrical connection to the leads is made.

19 Claims, 1 Drawing Sheet

SWITCH ASSEMBLY FOR WITHSTANDING SHOCK AND VIBRATION

STATEMENT OF GOVERNMENT INTENTION

The invention described herein may be manufactured and used by or for the Government of the United States of America for Governmental purposes without the payment of any royalties thereon or therefor.

BACKGROUND OF THE INVENTION (1) Field of the Invention

The present invention relates generally to switch assemblies, and more particularly to a switch assembly that can protect a delicate switch such as a reed switch from shock and vibration loads.

(2) Description of the Prior Art

Proximity switches are typically used to detect the presence or passage of an object. One type of proximity switch is the reed switch in which metallic strips (or reeds as they are known) are hermetically sealed in an elongate, air or gas-filled glass body. Each reed is connected to an electrical lead that passes out of the glass body at either end thereof. When a magnetic body is brought near a reed switch, magnetic forces cause overlapping portions of the reeds to contact one another thereby closing a circuit to which the electrical leads are connected.

The Navy uses such reed switches in various submarine launch systems to indicate launch tube and hatch valve positions. To protect the delicate glass bodies of the switches, they are epoxied to a housing and the housing is glued to a foundation. The assembly is then encapsulated in urethane. However, the switches' glass bodies have still been known to crack or break when experiencing shock or vibration loads. Further proper positioning of a reed switch on a platform is critical to its effective operation. Unfortunately, the method of simply gluing the housing in place makes proper positioning of the switch a skilled operation or simply leaves it to chance.

A variety of protective housing structures for reed switches have been developed. For example, U.S. Pat. Nos. 3,167,625 and 3,701,960 disclose mounting structures in which a glass reed switch is held in air within a spool-like frame by means of elastic collars or buffers. Wires connect to the terminals on the reed switch with the connections being subject to strain forces. Further, since the glass body of the reed switch is only supported at the collars or buffers, shock and vibration loads are focused at these few locations thereby increasing the chance that the glass body will fracture. U.S. Pat. No. 3,958,199 discloses a reed switch that is fully encapsulated in polyurethane. While this design tends to better damp out shock and vibration loads, proper and consistent positioning of the reed switch in the encapsulant during the manufacturing thereof is difficult to achieve.

SUMMARY OF THE INVENTION

Accordingly, it is an object of the present invention to provide a switch assembly capable of withstanding shock and vibration loads.

Another object of the present invention is to provide a switch assembly that reduces or eliminates the amount of skill or chance involved in the proper positioning of the switch assembly relative to a platform.

Still another object of the present invention is to provide a method of producing a switch assembly of consistent design and quality that is capable of withstanding shock and vibration loads and can reduce or eliminate the amount of skill or chance involved in the proper positioning of the switch assembly relative to a platform.

Other objects and advantages of the present invention will become more obvious hereinafter in the specification and drawings.

In accordance with the present invention, a plurality of seals are mounted in spaced apart relation about the elongate body of a switch such as a reed switch. A rigid housing encases the switch and seals such that the housing is in circumferential contact with each seal. The housing further has a port formed in a side thereof for accessing a cavity therein. A first and second seal from the plurality of sealsare spaced apart from one another on either side of the port so that an annular chamber is defined between the elongate body and the housing between the first and second seal. A damping material fills the annular chamber. The housing can extend past either end of the elongate body to define first and second open-ended chambers through which electrical leads extending from the elongate body pass through. The damping material can also be used to fill the first and second open-ended chambers once electrical connection to the leads is made. dr

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DESCRIPTION OF THE PREFERRED EMBODIMENT(S)

Figure 1:
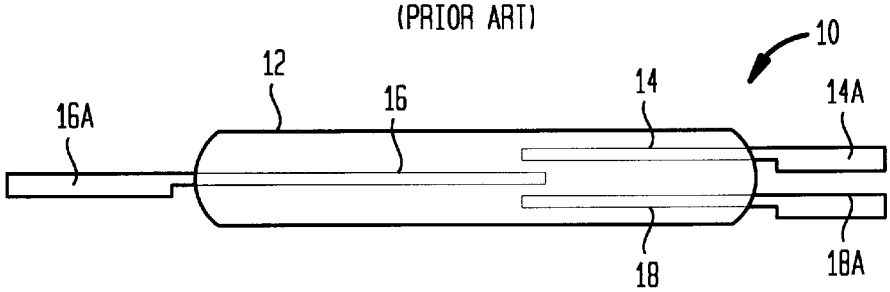
FIG. 1 (PRIOR ART)
FIG. 1 is a schematic view of a conventional reed switch.

Referring now to the drawings, and more particularly to FIG. 1, a typical reed switch is shown and referenced generally by numeral 10. While the present invention will be described relative to reed switch 10, it is to be understood that the present invention could be used to protect other types of switches from shock and vibration loads.

Switch 10 has an air or gas-filled elongate glass body 12 hermetically sealing a plurality of contacts 14, 16 and 18 therein. In the illustrated reed switch, the tip of contact 16 is interleaved with the tips of contacts 14 and 18. Depending on the presence and/or location of a magnetic force, contact 16 will either remain neutral between contacts 14 and 18 or move towards and contact one of contacts 14 and 18. Each of contacts 14, 16 and 18 extends out through a respective end of glass body 12 so that wires (not shown in FIG. 1) can couple a circuit (not shown) to reed switch 10.

Figure 2:
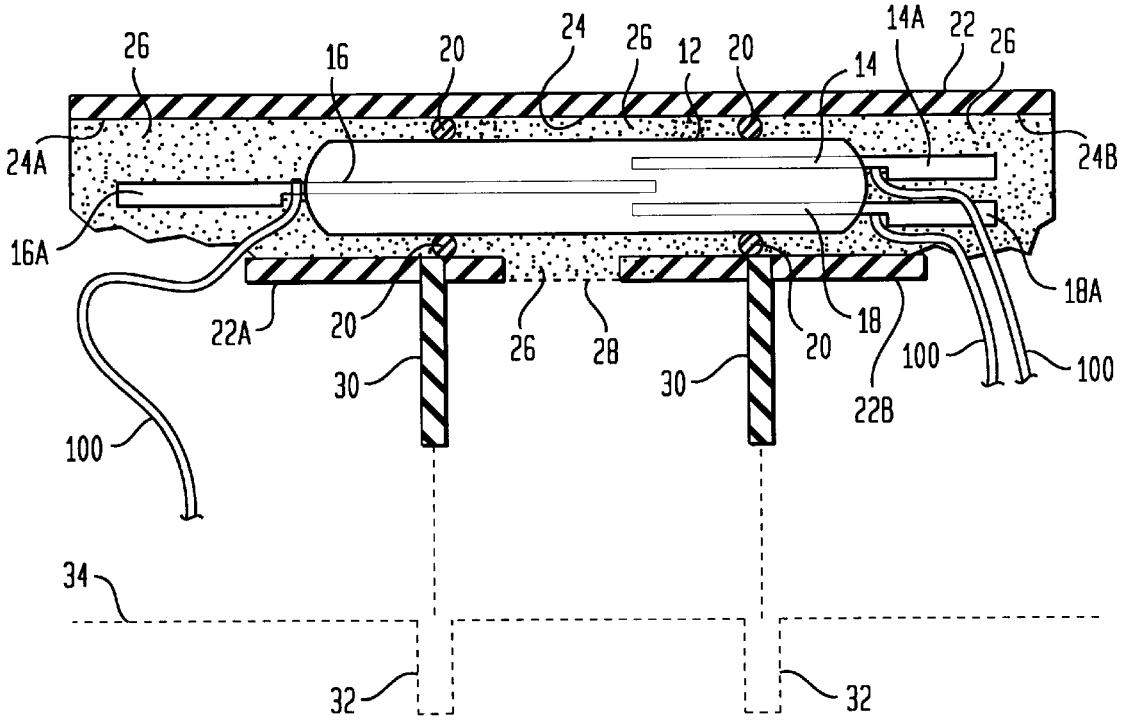
FIG. 2 is a cross-sectional view of a reed switch assembly in accordance with the present invention.

Referring now to FIG. 2, the switch assembly for protecting a switch (such as reed switch 10) will be described. Two flexible seals or 0-rings 20 are positioned about glass body 12 in a spaced-apart relation along the longitudinal axis of glass body 12. To assure that seals 20 stay in place during the assembly process, each of seals 20 can be bonded to glass body 12 with an adhesive. A hollow capsule or housing 22 encases the entire length of glass body 12 and seals 20 with the interior diameter of housing 22 sized such that it is in circumferential contact with each of seals 20.

Seals 20 center glass body 12 in housing 22 so that an annular chamber 24 is defined between glass body 12, housing 22 and seals 20. Annular chamber 24 is filled with a vibration damping material 26 such as a flexible resin-type silicon or any material having vibration damping properties. As will be explained below, a port 28 is provided in the side of housing 22 to permit the introduction of damping material 26 into chamber 24.

Housing 22 extends past glass body 12 at either end thereof. More specifically, housing 22 extends at either end thereof to at least the ends 14A, 16A and 18A of contacts 14, 16 and 18, respectively, extending from glass body 12. As a result, open-ended chambers 24A and 24B are formed at either end of housing 22. However, rather than completely encasing ends 14A, 16A and 18A, a portion of chambers 24A and 24B is cut-away from the ends of housing 22 at 22A and 22B to simplify access to ends 14A, 16A and 18A. In this way, connection of wires 100 to ends 14A, 16A and 18A is simplified, while still providing protection for the connection of wires 100. Wires 100 can be connected anywhere along ends 14A, 16A and 18A. Wires 100 are connected to a circuit (not shown) that will be controlled by the position of contacts 14, 16 and 18. Each of open-ended chambers 24A and 24B can also be filled with damping material 26 once wires 100 are connected.

To facilitate proper positioning of the switch assembly, a plurality (two are shown) of locator tabs or pins 30 are coupled to and extend from housing 22. Pins 30 can be rigid pins attached to (e.g., press-fit, glued, screwed, etc.) or integral with housing 22. When it is time to position the switch assembly, pins 30 can be inserted into holes 32 in a mounting platform 34 in order to insure the proper positioning of contacts 14, 16 and 18 for a particular application.

To make the switch assembly of the present invention, the following methodology is used. Seals 20 are placed on, and can be bonded to, glass body 12. The seal/glass body assembly is then threaded and pushed into one end of housing 22 until seals 20 are disposed on either side of port 28. Wires 100 are then attached to ends 14A, 16A and 18A. Damping material 26 is then introduced into annular chamber 24 via port 28 and, optionally, into open-ended chambers 24A and 24B.

The advantages of the present invention are numerous. Improved shock and vibration protection of a glass reed switch is achieved by enclosing it within a rigid housing and using flexible centering seals and damping material to isolate the switch within the housing. The rigid housing protects the glass reed switch while the seals and damping material damp out shock and vibration loads. The centering seals simplify the manufacturing process and guarantee consistent and proper positioning of the reed switch within the housing. The inclusion of locator pins for proper positioning of the switch assembly will eliminate the element of skill or chance normally associated with the installation of a proximity switch.

Although the present invention has been described relative to a specific embodiment thereof, it is not so limited. For example, for the proximity switch described herein, the materials used for seals 20, housing 22, damping material 26 and pins 30 should be non-magnetic so as not to affect switch performance. However, other switch types may use, or require the use of, magnetic materials for proper operation. Also, the particular shape and size of seals 20, housing 22 and pins 30 is not a limitation of the present invention. Further, more seals and/or locator pins can be used as needed. Additionally, wires 100 can be soldered onto ends 14A, 16A and 18A prior to inserting the seal/glass body assembly into housing 22.

Thus, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A switch assembly, comprising:

a switch having an elongate body;

a plurality of o-rings mounted in spaced apart relation about said elongate body;

a rigid housing having a port formed in a side thereof for accessing a cavity therein, said housing encasing said switch and said plurality of o-rings wherein said housing is in circumferential contact with each of said plurality of o-rings;

a first o-ring and a second o-ring from said plurality of o-rings being spaced apart from one another on either side of said port, wherein an annular chamber is defined between said elongate body and said housing between said first o-ring and said second o-ring; and a damping material filling said annular chamber.

2. A switch assembly as in claim 1 wherein said elongate body is made of glass.

3. A switch assembly as in claim 1 wherein said first o-ring and said second o-ring are affixed to said elongate body.

4. A switch assembly as in claim 1 wherein said housing, said plurality of o-rings and said damping material are non-magnetic.

5. A switch assembly as in claim 1 further comprising a plurality of rigid projections coupled to and extending from said housing for positioning said switch assembly in a particular orientation relative to a platform.

6. A switch assembly as in claim 5 wherein said plurality of rigid projections are non-magnetic.

7. A switch assembly as in claim 1 wherein said damping material is silicon.

8. A switch assembly as in claim 1 wherein said housing is shaped at either end thereof to facilitate access to either end of said elongate body.

9. A switch assembly, comprising:

a reed switch having an elongate body with electrical leads extending from a first end and a second end of said elongate body;

a first o-ring and a second o-ring mounted in spaced apart relation about said elongate body;

an elongate rigid housing having openings at either end thereof and having a port formed in a side thereof for accessing a cavity therein, said housing encasing said switch, said first o-ring and said second o-ring, said housing in circumferential contact with said first o-ring and said second o-ring, said housing extending past said first o-ring and said first end of said elongate body to define a first open-ended chamber, said housing extending past said second o-ring and said second end of said elongate body to define a second open-ended chamber, said electrical leads extending from said first end of said elongate body passing through said first open-ended chamber, said electrical leads extending from said second end of said elongate body passing through said second open-ended chamber;

said first o-ring and said second o-ring being spaced apart from one another on either side of said port, wherein an annular chamber is defined between said elongate body and said housing between said first o-ring and said second o-ring; and a damping material filling said annular chamber, said first open-ended chamber and said second open-ended chamber, said damping material encasing said electrical leads passing through each of said first open-ended chamber and said second open-ended chamber.

10. A switch assembly as in claim 9 wherein said elongate body is made of glass.

11. A switch assembly as in claim 9 wherein said first o-ring and said second o-ring are affixed to said elongate body.

12. A switch assembly as in claim 9 wherein said housing, said first o-ring, said second o-ring and said damping material are non-magnetic.

13. A switch assembly as in claim 9 further comprising a plurality of locator pins coupled to and extending from said housing.

14. A switch assembly as in claim 13 wherein said plurality of locator pins are non-magnetic.

15. A switch assembly as in claim 9 wherein said damping material is silicon.

16. A switch assembly as in claim 9 wherein:

a portion of said first open-ended chamber is shaped to facilitate access to said electrical leads extending from said first end of said elongate body; and a portion of said second open-ended chamber is shaped to facilitate access to said electrical leads extending from said second end of said elongate body.

17. A method of enclosing a switch in a protective assembly, said switch having an elongate body with electrical leads extending from a first end and a second end of said elongate body, said method comprising the steps of:

placing a first o-ring and a second o-ring on said elongate body such that said first o-ring and said second o-ring are spaced apart from one another relative to a longitudinal axis of said elongate body;

providing an elongate rigid housing longer than said elongate body and having a first opening and a second opening at opposing ends thereof and a port formed in a side thereof for accessing a cavity therein;

threading said electrical leads extending from said first end of said elongate body through said first opening of said housing;

pushing said elongate body along with said first o-ring and said second o-ring into said housing until said first o-ring and said second o-ring reside on either side of said port with said housing extending past said first o-ring and said first end of said elongate body to define a first open-ended chamber and said housing extending past said second o-ring and said second end of said elongate body to define a second open-ended chamber wherein said electrical leads extending from said first end of said elongate body pass through said first open-ended chamber and said electrical leads extending from said second end of said elongate body pass through said second open-ended chamber, said first o-ring and said second o-ring being in circumferential contact with said housing wherein an annular chamber is defined between said elongate body and said housing between said first o-ring and said second o-ring; and filling said annular chamber through said port with a damping material.

18. A method according to claim 17 further comprising the step of filling said first open-ended chamber and said second open-ended chamber with said damping material to encapsulate said electrical leads passing through each of said first open-ended chamber and said second open-ended chamber.

19. A method according to claim 17 further comprising the step of affixing said first o-ring and said second o-ring to said elongate body prior to said step of pushing.

* * * * *